US005080624A

United States Patent [19]

Brinker

[11] Patent Number: 5,080,624

[45] Date of Patent: Jan. 14, 1992

[54] MULTI DISC FLYING TOY FEATURING LIFT PRODUCING FINS

[76] Inventor: Sheridan F. Brinker, 1621 Sweem St., Oroville, Calif. 95965

[21] Appl. No.: 624,874

[22] Filed: Nov. 30, 1990

[51] Int. Cl.[5] ..... A63H 27/00; A63H 27/127; A63H 1/06; A63B 65/10

[52] U.S. Cl. ..... 446/48; 446/36; 446/44; 446/266; 273/425

[58] Field of Search ..... 446/48, 47, 46, 36, 446/37, 38, 44, 45, 34, 236, 255, 266, 233; 273/425, 428

[56] References Cited

U.S. PATENT DOCUMENTS

| | | | |
|---|---|---|---|
| 2,418,269 | 4/1947 | Lewis | 446/44 |
| 2,469,144 | 5/1949 | Baggott | 446/232 |
| 2,598,349 | 5/1952 | Carrington | 446/44 |
| 3,229,416 | 1/1966 | Bross | 446/38 |
| 3,742,643 | 7/1973 | Keith | 446/46 |
| 4,212,131 | 7/1980 | Ross, Jr. | 446/48 |
| 4,370,824 | 2/1983 | Resnicow | 446/48 |
| 4,752,267 | 6/1988 | Layman | 446/46 |

FOREIGN PATENT DOCUMENTS

| | | | |
|---|---|---|---|
| 467331 | 12/1951 | Italy | 446/38 |
| 215894 | 5/1924 | United Kingdom | 446/38 |

*Primary Examiner*—D. Neal Muir

*Attorney, Agent, or Firm*—Norman B. Rainer

[57] ABSTRACT

A flying disc toy has at least two circular spinners rotatably mounted upon a centered axle. Each spinner has a number of fins which cause the spinner to rotate when thrown into the air. The spinners rotate in counter direction, thereby causing the toy to lift when thrown with a twisting motion. The subject matter of this application is disclosed in Disclosure Document #254258, dated June 4, 1990.

6 Claims, 2 Drawing Sheets

MULTI DISC FLYING TOY FEATURING LIFT PRODUCING FINS

BACKGROUND OF THE INVENTION

1. Field of the Invention

This invention relates to flying disc toys and more particularly concerns a multiple wing flying toy which spins in flight and generates lift and a distictive humming sound.

2. Description of the Prior Art

Flying disc toys have gained a place as a stable item in the field of recreational devices. Among the most popular of these toys is the ubiquitous Frisbee flying disk which has been developed into a high-performance recreational implement. These flying discs usually have a saucer-like configuration and, when thrown, spin about a central axis as they fly along an arched trajectory. Typically, the flying disc will have a curved convex upper surface and a corresponding concave lower surface, said surfaces merging in a turned down rim which is manually grasped for tossing the toy in the air with a spinning motion.

The curved upper surface of the toy flying saucer acts as a wing while spinning through the air. The air movement over the upper surface creates a lifting force which offsets the gravitational pull downward to the ground. Therefore, the saucer is capable of sustaining flights of longer duration when thrown with a spinning motion than when merely dropped or thrown without spin. Since the ratio of lift to mass must be substantial enough to offset gravity, flying saucer toys are usually contructed of lightweight plastic.

Most flying saucer toys do not generate a large enough lifting force to overcome gravity, and therfore it is seldom that a flying saucer will climb upward while in flight. Greater time aloft and more favorable flight characteristics may be achieved by increasing the ratio of lift to mass generated by the toy in flight. Greater lifting force may be achieved by increasing the surface area and/or pitch of the wing. Due to the design contraints of a simple flying saucer toy, there is a tradeoff between pitch and surface area of the wing, and either may be altered little from the optimal design.

Conventional toy flying saucers are generally capable of soaring silently through the air. It is readily apparent that if such toys were capable of emitting a sound while being sailed through the air and spinning, additional enjoyment would result from such characteristics of the toy. Various devices have been disclosed in the prior art which serve to provide sound. As shown in U.S. Pat. No. 4,246,720, such devices may employ a multiplicity of cantilievered radial vanes or appendages attached to the upper suface which flutter in flight to produce sound. Other devices, such as shown in U.S. Pat. No. 4,117,626 incorporate a double wall which may be separated to form an air bladder which expells air through a noise-making orifice during flight. Yet other devices utilize noise makers or whistles arranged about the perimeter of the device. However, all of these devices generally add extra weight to the toy and deleteriously effect the ratio of lift to mass. Furthermore, the protruding vanes, handles, whistles, etc. significantly add to wind resistance or drag. The result of this increased drag is a rapidly diminishing rate of rotation in flight, which causes loss of lift and reduced time and distance aloft.

It is therefore an object of the present invention to provide a flying saucer toy with an improved lift to mass ratio, thereby allowing the toy to exhibit a climbing trajectory with attendant increased time and distance aloft.

It is another object of the present invention to provide a toy of the aforesaid nature which makes a distictive sound in flight without sacrifice of flight characteristics.

It is yet another object of the present invention to provide a toy of the aforesaid nature which is easy to manipulate, appealing aesthetically and in performance, and amenable to low cost manufacture.

SUMMARY OF THE INVENTION

The above and other beneficial objects and advantages are accomplished in accordance with the present invention by an improved flying-saucer type toy comprised of:

a) top and bottom spinners rotatably disposed upon a centered axle and in close proximity, said spinners comprised of:
   1) a central hub having a vertical bore which receives said axle,
   2) a rigid outer circular rim in coplanar alignment with said hub, said rim having upper and lower edges, an interior circumferential surface, and an exterior circular gripping flange outwardly extending from said rim,
   3) a plurality of uniformly spaced elongated fins having proximal and distal extremities, upper and lower surfaces, and leading and trailing edges, said proximal extremities fixedly associated with said hub, said distal extremities fixedly associated with the interior surface of said rim, said fins being pitched to dispose said leading edge in coplanar alignment with the upper edge of said rim, and said trailing edge in coplanar alignment with the lower edge of said rim, thereby disposing said upper surfaces at a uniform pitch, the pitch of the fins of said top spinner being equal to but opposite to the pitch of the fins of said bottom spinner, b) a vertical axle journaled to said bores and having upper and lower extremities, and c) retaining members associated with the upper and lower extremities of said axle, said retaining members maintaining said spinners in close proximity upon said axle.

In an alternative embodiment, the toy may be comprised of three spinners. In such embodiments the top and bottom spinners are adapted to rotate in a common direction, and the center spinner is adapted to rotate in a counter direction, thereby generating a greater amount of lift and distictively different sound.

In a preferred embodiment the spinners are constructed of lightweight injection molded plastic.

In another preferred embodiment the leading and trailing edges are curved to provide modified flight characteristics.

In yet another preferred embodiment, a bushing may be disposed between said spinners upon said axle to reduce friction between the spinners.

BRIEF DESCRIPTION OF THE DRAWING

For a fuller understanding of the nature and objects of the invention, reference should be had to the following detailed description taken in connection with the accompanying drawing forming a part of this specification and in which similar numerals of reference indicate corresponding parts in all the figures of the drawing.

DESCRIPTION OF THE PREFERRED EMBODIMENT

Figure 1:
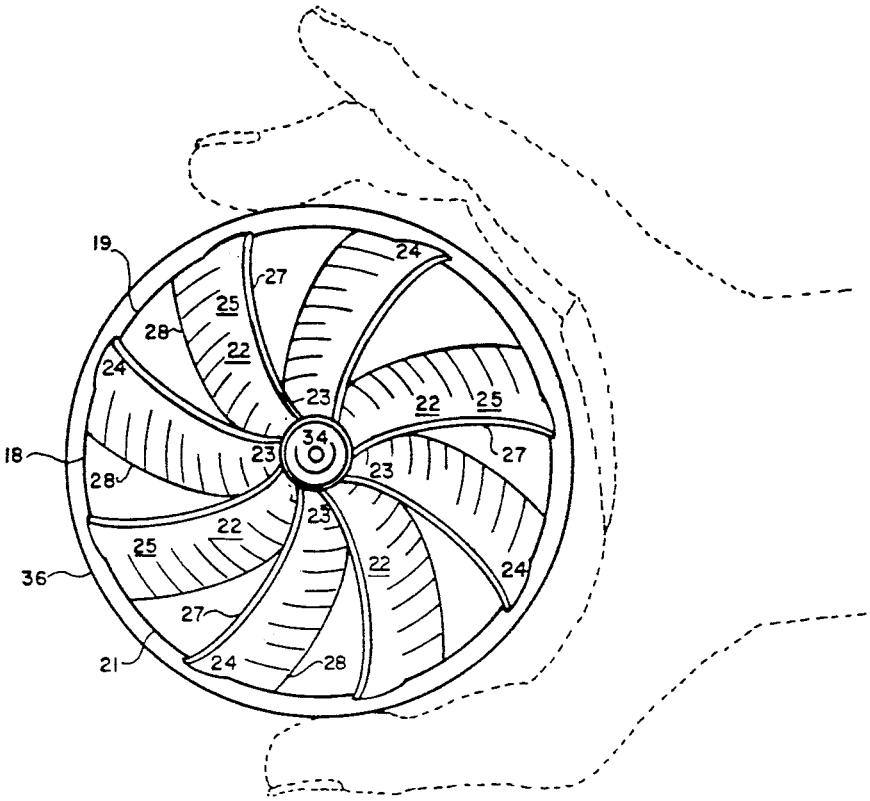
FIG. 1 is a top plan view of an embodiment of the toy of the present invention shown hand-held for initiation of flight.
Figure 2:
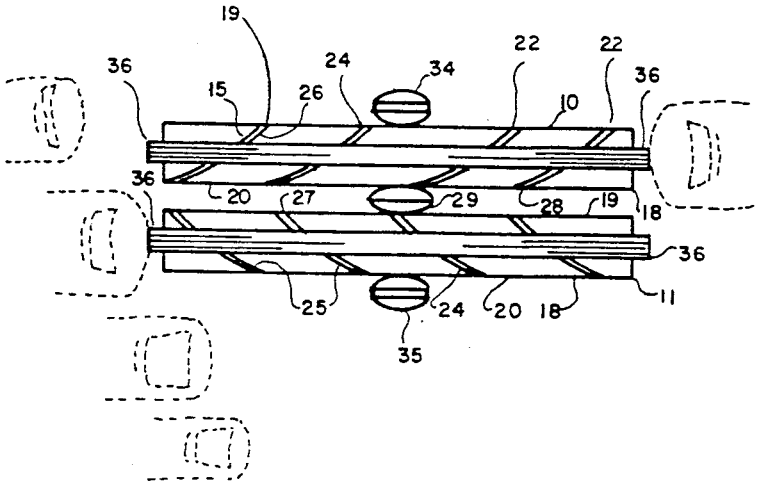
FIG. 2 is a side view of the embodiment of FIG. 1.
Figure 4:
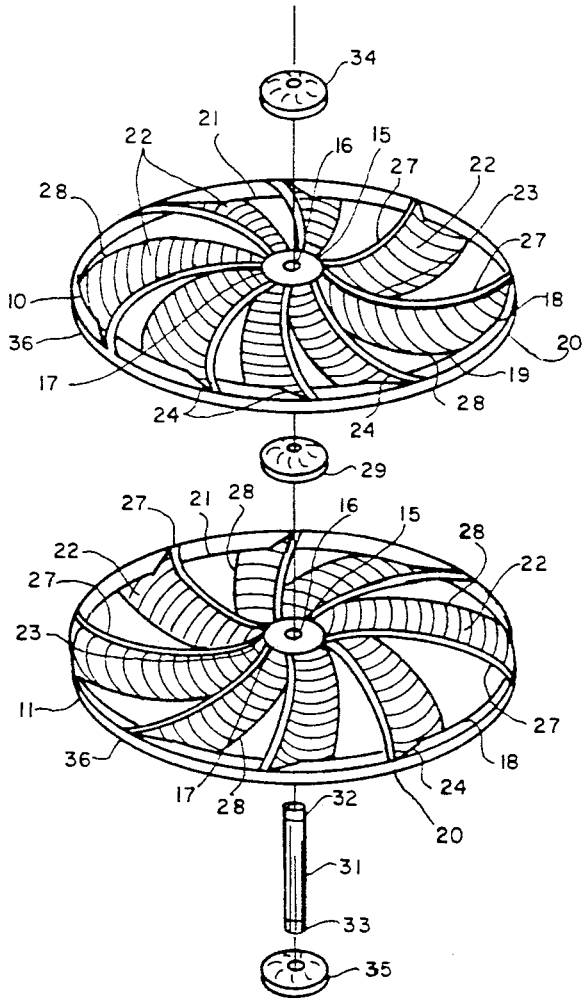
FIG. 4 is an exploded perspective view of the embodiment of FIG. 2.

Referring to FIGS. 1, 2 and 4, an embodiment of the flying disc toy of the present invention is shown comprised of first and second counter-rotating spinners 10 and 11, respectively, orthogonally disposed upon a centered vertical axle 31 and in close proximity. Each spinner has a central hub 15 having a vertical bore 16 penetrated by axle 31, and external circumferential surface 17. Rigid outer circular rim 18 is in coplanar alignment with hub 15 and has upper and lower edges 19 and 20, respectively, interior circumferential surface 21, and outwardly directed exterior circular gripping flange 36.

Uniformly spaced elongated fins 22 have proximal and distal extremities 23 and 24, respectively, and upper and lower surfaces, 25 and 26, respectively. In the illustrated embodiments, leading and trailing edges 27 and 28, respectively are curved to provide more favorable flight characteristics. The proximal extremities 23 of the fins are fixedly associated with external surface 17 of hub 15 in sequential overlapping disposition. Distal extremities 24 are fixedly associated with interior surface 21 of rim 18. The fins 22 are canted to dispose leading edge 27 in coplanar alignment with upper edge 19 of said rim 18 and trailing edge 28 in coplanar alignment with lower edge 20 of said rim, thereby disposing upper surfaces 25 at a uniform pitch. The pitch of fins 22 of first spinner 10 is equal to but opposite to the pitch of the fins of second spinner 11.

Elongated vertical axle 31 is journaled to bores 16 and has upper and lower extremities, 32 and 33, respectively. Upper and lower retaining members 34 and 35, respectively, are associated with said upper and lower extremities 32 and 33, respectively, maintaining spinners 11 and 12 in close proximity upon axle 31. A spacer bushing 29 is disposed upon the axle between the spinners.

Figure 3:
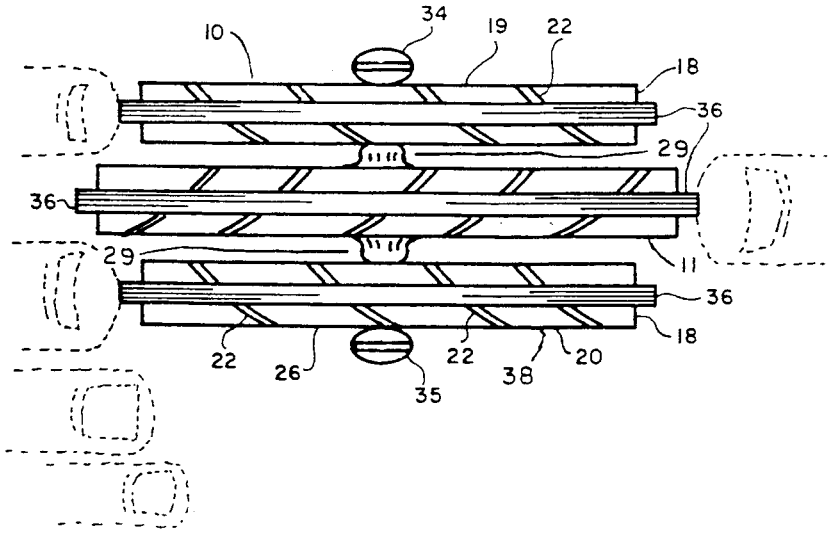
FIG. 3 is a side view of an alternative embodiment of the toy of the present invention shown held as to be manipulated upon initiation of flight.

In the alternative embodiment illustrated in FIG. 3, the toy has third spinner 38 disposed upon axle 31. In the illustrated embodiment, first and third spinners 10 and 38, respectively, are adapted to rotate in a common direction, and the intervening second spinner 11 is adapted to rotate in a counter direction, thereby generating a greater amount of lift and a distictively different sound. Bushings 29 are interposed between spinners 10, 11, and 38 upon axle 31 to reduce friction between the spinners. However, the function of the bushings may instead be provided by appropriate design of hubs 15.

Flight of the toy is initiated by grasping the toy as illustrated with two fingers placed upon gripping flanges 36 of first and third spinners 10 and 38, respectively, and thumb upon the flange of second spinner 11. The toy is hurled with a backhand motion of the arm and a snap of the wrist. At the point of full extension of the arm, the fingers and thumb are drawn together in a snapping motion. The toy is launched into the air with an initial climbing trajectory. The air moving through fins 22 creates an aethetically pleasing humming sound.

The number of fins may range from about 4 to 10 for each spinner. The fins may be straigt or arcuate in their extension between the hub and the rim. The thickness of the fins may be graded such that the leading edge is thicker than the trailing edge. The leading edge of each fin may have a tapered or rounded contour so as to promote streamlining. The width of the fins may be greater at their proximal extremities than at their distal extremities. Each spinner is preferably of monolithic construction, fabricated of a thermoplastic polymer by injection molding.

While particular examples of the present invention have been shown and described, it is apparent that changes and modifications may be made therein without departing from the invention in its broadest aspects. The aim of the appended claims, therefore is to cover all such changes and modifications as fall within the true spirit and scope of the invention.

Having thus described my invention, what is claimed is:

1. A flying-saucer type toy comprised of:

a) top and bottom spinners rotatably disposed upon a centered axle and in close proximity, said spinners comprised of:

1) a central hub having a vertical bore which receives said axle.

2) a rigid outer circular rim in coplanar alignment with said hub, said rim comprised of a circumferential surface having upper and lower edges and a gripping flange outwardly extending from said circumferential surface.

3) a plurality of uniformly spaced elongated fins having proximal and distal extremities, upper and lower surfaces, and leading and trailing edges, said proximal extremities fixedly associated with said hub, said distal extremities fixedly associated with said rim, said fins being pitched to dispose said leading edges in coplanar alignment, and said trailing edges in coplanar alignment, thereby disposing said upper surfaces at a uniform pitch, b) a vertical axle journaled to said bores and having upper and lower extremities, and c) retaining members associated with the upper and lower extremities of said axle, said retaining members maintaining said spinners in close proximity upon said axle, d) whereupon throwing of the toy by contacting said gripping edges, the spinners are counter rotated upon release to cause said fins to generate lift.

2. The toy of claim 1 wherein the pitch of the fins of said top spinner is equal but opposite to the pitch of the fins of said bottom spinner.

3. The toy of claim 1 wherein the top and bottom spinners are identical except for the direction of pitch of said fins.

4. The toy of claim 1 wherein said spinners are monolithic structures fabricated from a thermoplastic resin.

5. A flying-saucer type toy comprised of:

a) top and bottom spinners and a third spinner disposed between said top and bottom spinners, said spinners being rotatably disposed upon a centered axle and comprised of:

1) a central hub having a vertical bore which receives said axle, 2) a rigid outer circular rim in coplanar alignment with said hub, said rim comprised of a circumferential surface having upper and lower edges and a gripping flange outwardly extending from said circumferential surface, 3) a plurality of uniformly spaced elongated fins having proximal and distal extremities, upper and lower surfaces, and leading and trailing edges, said proximal extremities fixedly associated with said hub, said distal extremities associated with said rim, said fins being pitched to dispose said leading edges in coplanar alignment, and said trailing edges in coplanar alignment, thereby disposing said upper surfaces at a uniform pitch, b) a vertical axle journaled to said bores, and c) retaining members associated with said axle and serving to maintain said spinners in close proximity upon said axle.

6. The toy of claim 5 wherein the pitch of the fins of the top and bottom spinners are in the same direction, and the pitch of the fins of said third spinner is in a direction opposite to the pitch of said top and bottom spinners.

* * * * *